US008860647B2

(12) United States Patent
Yeh et al.

(10) Patent No.: US 8,860,647 B2
(45) Date of Patent: Oct. 14, 2014

(54) LIQUID CRYSTAL DISPLAY APPARATUS AND SOURCE DRIVING CIRCUIT THEREOF

(71) Applicant: ILI Technology Corporation, Jhubei (TW)

(72) Inventors: Sung-Yau Yeh, Jhubei (TW); Chin-Kang Cheng, Hsinchu (TW); Bing-Hung Chen, Taipei (TW)

(73) Assignee: ILI Technology Corporation, Jhubei (TW)

( * ) Notice: Subject to any disclaimer, the term of this patent is extended or adjusted under 35 U.S.C. 154(b) by 94 days.

(21) Appl. No.: 13/798,714

(22) Filed: Mar. 13, 2013

(65) Prior Publication Data

US 2013/0293451 A1 Nov. 7, 2013

(30) Foreign Application Priority Data

May 3, 2012 (TW) ..... 101115775 A

(51) Int. Cl.
*G09G 3/36* (2006.01)

(52) U.S. Cl.
CPC ..... *G09G 3/36* (2013.01)
USPC ..... 345/99; 345/87; 345/104; 345/211

(58) Field of Classification Search
None
See application file for complete search history.

(56) References Cited

U.S. PATENT DOCUMENTS

2008/0252623 A1* 10/2008 Yi ..... 345/204
2010/0289945 A1* 11/2010 Kobayashi et al. ..... 348/441
2012/0146520 A1* 6/2012 Liu et al. ..... 315/192

* cited by examiner

*Primary Examiner* — Muhammad N Edun
(74) *Attorney, Agent, or Firm* — Nixon & Vanderhye P.C.

(57) ABSTRACT

A liquid crystal display apparatus includes a liquid crystal panel and a panel driving device. The panel driving device includes a timing control circuit, a gate driving circuit, and a source driving circuit. The source driving circuit includes a low voltage differential signal (LVDS) receiver, a driving voltage generator, and a controller. The LVDS receiver includes a plurality of receive circuits and a power saving control circuit. Each of the receive circuit performs level conversion upon a data LVDS to generate a logic signal, and operates in a selected one of a normal energy consuming mode and a power saving mode. The power saving control circuit controls the receive circuits to operate in the power saving mode when the power saving control circuit does not receive a power adjustment signal from the controller.

10 Claims, 3 Drawing Sheets

LIQUID CRYSTAL DISPLAY APPARATUS AND SOURCE DRIVING CIRCUIT THEREOF

CROSS-REFERENCE TO RELATED APPLICATION

This application claims priority of Taiwanese application no. 101115775, filed on May 3, 2012.

BACKGROUND OF THE INVENTION

1. Field of the Invention

The invention relates to a display apparatus and more particularly to a liquid crystal display apparatus and a source driving circuit.

2. Description of the Related Art

A source driver is used in a thin film transistor liquid crystal display (TFT-LCD). The source driver drives a panel according to pixel data in the form of low voltage differential signal (LVDS). However, the drawback of the conventional source driver is that the current used during operation is not dynamically adjusted when switching from a working mode to a standby mode, causing unnecessary power consumption and electromagnetic interference in the standby mode. In the working mode, the source driver receives and processes pixel data, while in the standby mode, the source driver does not receive any pixel data.

SUMMARY OF THE INVENTION

Therefore, an object of the present invention is to provide a liquid crystal display apparatus and a source driving circuit that can reduce power consumption and electromagnetic interference.

According to one aspect of the present invention, the liquid crystal display apparatus comprises:

- a liquid crystal panel including a plurality of pixel units, each of the pixel units being disposed to receive a source driving voltage and a gate voltage; and
- a panel driving device including
  - a timing control circuit operable to generate a gate control signal and a data latch signal,
  - a gate driving circuit coupled to the liquid crystal panel and the timing control circuit, the gate driving circuit receiving the gate control signal and generating the gate voltages for the pixel units according to the gate control signal, and
  - a source driving circuit including
    - a low voltage differential signal (LVDS) receiver including:
      - a plurality of receive circuits, each disposed to receive a data LVDS and to perform level conversion upon the data LVDS to generate a logic signal, each of the receive circuits being operable in a selected one of a normal energy consuming mode and a power saving mode, and
      - a power saving control circuit coupled to the receive circuits for controlling operation of the receive circuits in the power saving mode;
    - a driving voltage generator disposed to receive a clock signal and coupled to the receive circuits so as to receive the logic signals therefrom, the driving voltage generator being operable to generate the source driving voltages for the pixel units in parallel by performing series-to-parallel conversion upon the logic signals according to multiple periods of high-low logic transitions of the clock signal, the driving voltage generator further outputting an END signal; and
    - a controller coupled to the driving voltage generator so as to receive the END signal therefrom, coupled to the timing control circuit so as to receive the data latch signal therefrom, and operable to output a power adjustment signal from the data latch signal and to stop output of the power adjustment signal upon receipt of the END signal from the driving voltage generator, the controller being coupled to the power saving control circuit for providing the power adjustment signal thereto, the power saving control circuit controlling the receive circuits to operate in the power saving mode when the power saving control circuit does not receive the power adjustment signal from the controller.

According to another aspect of the present invention, the source driving circuit comprises:

- a low voltage differential signal (LVDS) receiver including:
  - a plurality of receive circuits, each disposed to receive a data LVDS and to perform level conversion upon the data LVDS to generate a logic signal, each of the receive circuits being operable in a selected one of a normal energy consuming mode and a power saving mode, and
  - a power saving control circuit coupled to the receive circuits for controlling operation of the receive circuits in the power saving mode;
- a driving voltage generator disposed to receive a clock signal and coupled to the receive circuits so as to receive the logic signals therefrom, the driving voltage generator being operable to generate a plurality of source driving voltages in parallel by performing series-to-parallel conversion upon the logic signals according to multiple periods of high-low logic transitions of the clock signal, the driving voltage generator further outputting an END signal; and
- a controller coupled to the driving voltage generator so as to receive the END signal therefrom, disposed to receive a data latch signal, and operable to output a power adjustment signal from the data latch signal and to stop output of the power adjustment signal upon receipt of the END signal from the driving voltage generator, the controller being coupled to the power saving control circuit for providing the power adjustment signal thereto, the power saving control circuit controlling the receive circuits to operate in the power saving mode when the power saving control circuit does not receive the power adjustment signal from the controller.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
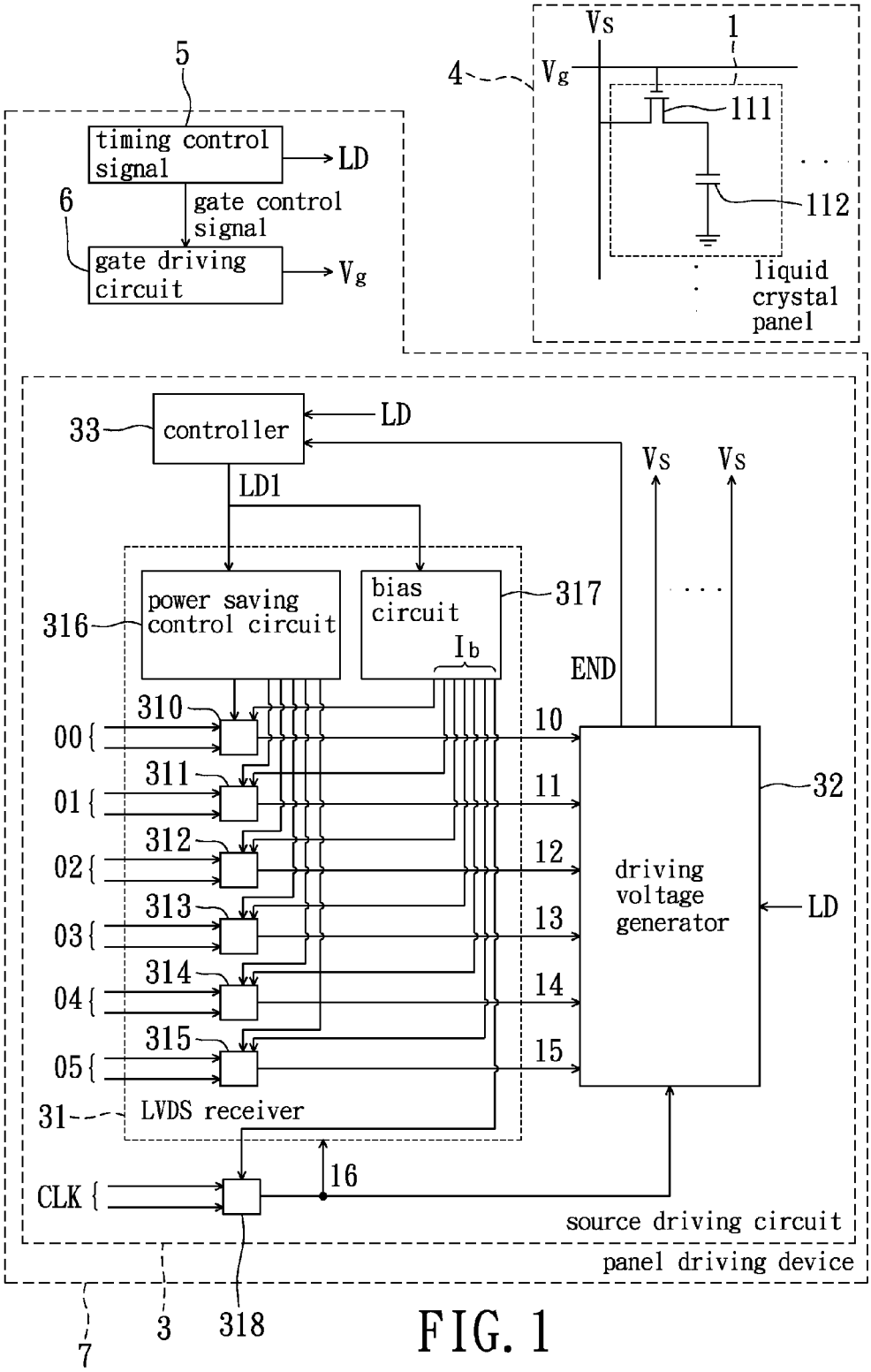
FIG. 1 is a schematic diagram showing the source driving circuit in a preferred embodiment according to the present invention.
Figure 3:
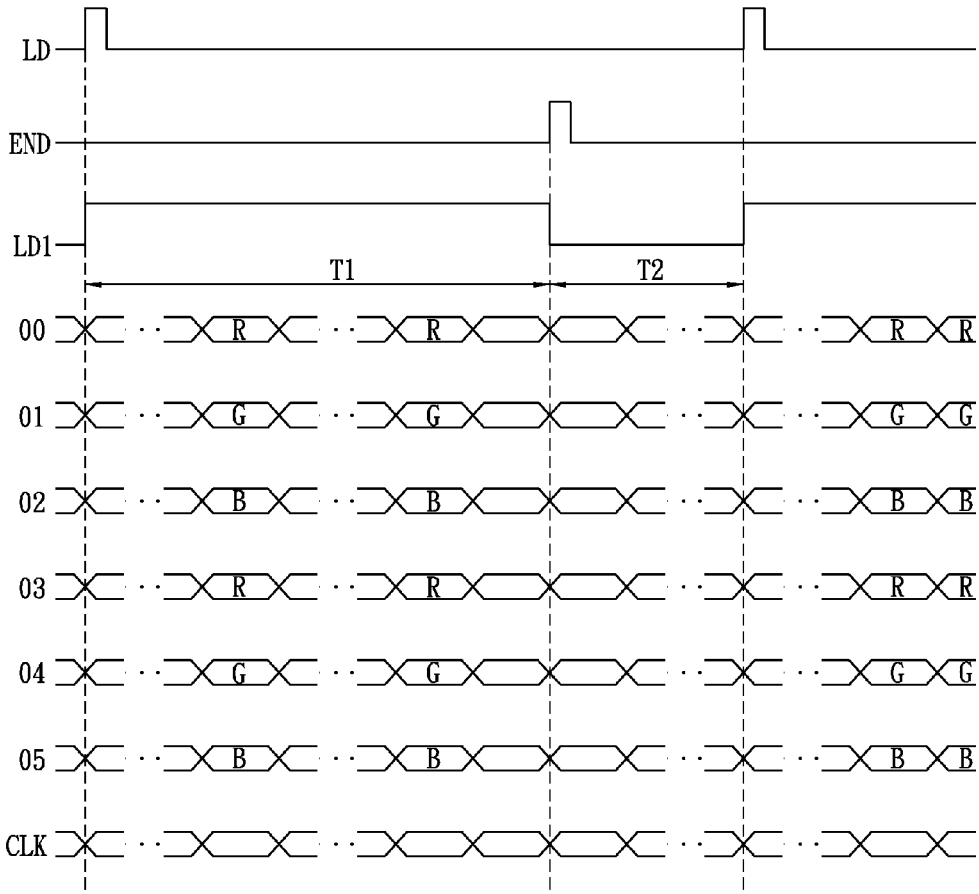
FIG. 3 is a timing diagram illustrating different signals in the preferred embodiment.

Referring to FIGS. 1 and 3, the preferred embodiment of the liquid crystal display apparatus of the present invention includes a liquid crystal panel 4 and a panel driving device 7. The liquid crystal panel 4 includes a plurality of pixel units 1 (only a single pixel unit is shown in the figure), and each pixel unit 1 includes a thin film transistor 11 and a pixel capacitor 12. The thin film transistor 11 includes a source terminal for receiving a source driving voltage Vs, a gate terminal for receiving a gate voltage Vg and a drain terminal. The pixel capacitor 12 includes a first terminal electrically connected with the drain terminal of the thin film transistor 11, and a second terminal that is grounded.

The panel driving device 7 includes a timing control circuit 5, a gate driving circuit 6 and a source driving circuit 3. The timing control circuit 5 is used for generating a gate control signal and a data latch signal LD. The gate driving circuit 6 is electrically connected to the liquid crystal panel 4, and is electrically connected with the timing control circuit 5 to receive the gate control signal. In response to control of the gate control signal, the gate driving circuit 6 generates a plurality of gate voltages Vg (only one is shown in the FIG. 1).

The source driving circuit 3 includes a controller 33, a low voltage differential signal (LVDS) receiver 31, a clock circuit 318, and a driving voltage generator 32.

The clock circuit 318 is electrically connected with the low voltage differential signal (LVDS) receiver 31 and the driving voltage generator 32, and receives a differential clock signal CLK and generates a clock signal 16 therefrom.

The driving voltage generator 32 receives the clock signal 16 and a plurality of logic signal sets 10-15, and each of logic signal sets 10-15 includes a plurality of serial logic signals. The driving voltage generator 32, according to multiple periods of high-low logic transitions of the clock signal 16, performs series-to-parallel conversion upon the logic signal sets 10-15 to generate a plurality of source driving voltages Vs for the source terminals of the transistors 11, and outputs an end signal END.

The controller 33 receives a data latch signal LD, and outputs a power adjustment signal LD1 upon receiving the data latch signal LD. The controller 33 is electrically connected with the driving voltage generator 32, and the controller 33 stops outputting the power adjustment signal LD1 after the controller 33 receives the end signal END from the driving voltage generator 32.

The LVDS receiver 31 includes a plurality of receive circuits 310-315, a power saving control circuit 316 and a bias circuit 317. The LVDS receiver 31 is used to convert a plurality of data LVDS 00-05 to the plurality of logic signal sets 10-15. In the illustrative example, the data LVDS signals 00-05 includes but is not limited to six signals.

The receive circuits 310-315 receive the data LVDS 00-05 and output the logic signal sets 10-15, respectively. The receive circuits 310-315 are also controlled by the power saving control circuit 316 to operate in a selected one of normal energy consuming mode T1 and a power saving mode T2.

The power saving control circuit 316 is electrically coupled with the controller 33, the driving voltage generator 32, and the receive circuits 310-315. The power saving controller circuit 316 controls the receive circuits 310-315 to operate in the power saving mode T2 when the power saving controller circuit 316 does not receive the power adjustment signal LD1. On the other hand, the power saving controller circuit 316 controls the receive circuits 310-315 to operate in the normal energy consuming mode T1 when the power saving controller circuit 316 receives the power adjustment signal LD1.

The bias circuit 317 is electrically coupled to the controller 33, the plurality of receive circuits 310-315, and the clock circuit 318. The bias circuit 317 provides a plurality of bias currents $I_b$ to respectively drive the plurality of receive circuit 310-315 and the clock circuit 318. When the bias circuit 317 receives the power adjustment signal LD1, the bias circuit 317 adjusts the level of the bias currents $I_b$ to a normal level. On the other hand, when the bias circuit 317 does not receive the power adjustment signal LD1, the bias circuit 317 adjusts the level of the bias currents $I_b$ to be below the normal level.

Figure 2:
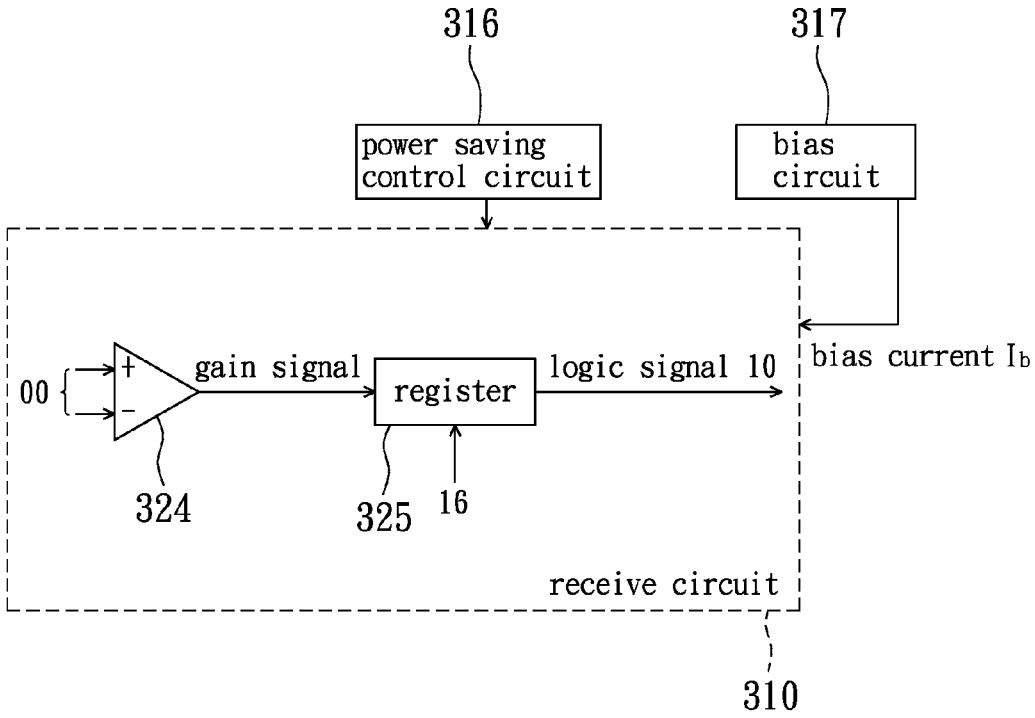
FIG. 2 is a block diagram of the receive circuit of the preferred embodiment.

Referring to FIG. 2, the receive circuit 310 includes an operational amplifier 324 and a register 325. The operational amplifier 324 receives data LVDS 00 and performs a level adjustment thereon to generate a gain signal having a magnitude of a transistor logic level. The register 325 receives the clock signal 16, is coupled electrically with the driving voltage generator 32, and is coupled electrically with the operational amplifier 324 to receive and store the gain signal. The register 325 outputs the gain signal stored thereby as the logic signal set 10 according to the clock signal 16. The receive circuits 310-315 have the same type of structure and therefore will not be further discussed.

The power saving control circuit 316 switches the operational amplifier 324 ON in the normal energy consuming mode T1 and the operational amplifier 324 OFF in the power saving mode T2. Since the power saving control circuit 316 and the bias circuit 317 can be independently controlled, different policies of signal transmission can be adapted by independently controlling ON/OFF states of the operational amplifier 324 and the level of the bias currents $I_b$.

Referring to FIG. 3, the power adjustment signal LD1 rises at the same time the data latch signal LD rises, and falls when the end signal END rises. When the power adjustment signal LD1 is at a high state, each of the receive circuits 310-315 is in the normal energy consuming mode T1, and receives a corresponding one of the data LVDS 00-05. At this time, the bias currents $I_b$ of the bias circuit 317 are at a normal level. The data LVDS 00, 03 are red pixel signal R, data LVDS 01, 04 are green pixel signal G, and data LVDS 02, 05 are blue pixel signal B. In FIG. 3, signals that are not labeled as R, G or B are don't care data. After at least one clock after the rise of the data latch signal LD, transmission of the R, G, B pixel signals are executed, and after at least one clock after the transmission of the R, G, B pixel signals, the end signal END outputted by the driving voltage generator 32 rises. Therefore, the time period of the normal energy consuming mode T1 is longer than the time of transmission of the R, G, B pixel signals to ensure integrity of data transmission.

After the transmission of the pixel signals 00-05, the source driving circuit 3 outputs the processed signals and then goes into a standby mode, waiting for the gate driving circuits 6 that are electrically coupled with the rows of pixel units 1 to complete their operations. At this instance, the driving voltage generator 32 outputs the end signal END. Subsequently, the power adjustment signal LD1 falls, and the power saving control circuit 316 controls the receive circuits 310-315 to be in the power saving mode T2, in which the bias currents $I_b$ of the bias circuit 317 are below the normal level.

After the rise of the next data latch signal LD, the power adjustment signal LD1 rises, the receive circuits 310-315 re-enters the normal energy consuming mode T1, and the bias currents $I_b$ of the bias circuit 317 returns to the normal level.

Therefore, the above described preferred embodiment has the advantages of switching between the normal energy consuming mode T1 and the power saving mode T2, and dynamically adjusting the level of the driving current that is consumed to reduce power consumption. In the power saving mode T2, the receive circuits 310-315 can be switched off or work under a low current to reduce the overall power consumption of the low voltage differential signal receiver 31, and to reduce electromagnetic interferences. Such advantage is obvious when the time period of the power saving mode T2 is five to ten times longer than that of the normal energy consuming mode T1, which is fairly common.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A liquid crystal display apparatus comprising:

a liquid crystal panel including a plurality of pixel units, each of the pixel units being disposed to receive a source driving voltage and a gate voltage; and a panel driving device including a timing control circuit operable to generate a gate control signal and a data latch signal, a gate driving circuit coupled to the liquid crystal panel and the timing control circuit, the gate driving circuit receiving the gate control signal and generating the gate voltages for the pixel units according to the gate control signal, and a source driving circuit including a low voltage differential signal (LVDS) receiver including:

a plurality of receive circuits, each disposed to receive a data LVDS and to perform level conversion upon the data LVDS to generate a logic signal, each of the receive circuits being operable in a selected one of a normal energy consuming mode and a power saving mode, and a power saving control circuit coupled to the receive circuits for controlling operation of the receive circuits in the power saving mode;

a driving voltage generator disposed to receive a clock signal and coupled to the receive circuits so as to receive the logic signals therefrom, the driving voltage generator being operable to generate the source driving voltages for the pixel units in parallel by performing series-to-parallel conversion upon the logic signals according to multiple periods of high-low logic transitions of the clock signal, the driving voltage generator further outputting an END signal; and a controller coupled to the driving voltage generator so as to receive the END signal therefrom, coupled to the timing control circuit so as to receive the data latch signal therefrom, and operable to output a power adjustment signal from the data latch signal and to stop output of the power adjustment signal upon receipt of the END signal from the driving voltage generator, the controller being coupled to the power saving control circuit for providing the power adjustment signal thereto, the power saving control circuit controlling the receive circuits to operate in the power saving mode when the power saving control circuit does not receive the power adjustment signal from the controller.

2. The liquid crystal display apparatus as claimed in claim 1, wherein the power saving control circuit controls the receive circuits to operate in the normal energy consuming mode when the power saving control circuit receives the power adjustment signal from the controller.

3. The liquid crystal display apparatus as claimed in claim 2, wherein the LVDS receiver further includes:

a bias circuit coupled to the controller and the receive circuits, the bias circuit receiving the power adjustment signal and being operable to provide bias currents for driving the receive circuits respectively, the bias currents being at a normal level when the bias circuit receives the power adjustment signal from the controller, the bias currents being at a level lower than the normal level when the bias circuit does not receive the power adjustment signal from the controller.

4. The liquid crystal display apparatus as claimed in claim 3, wherein the source driving circuit further includes a clock circuit coupled to the LVDS receiver and the driving voltage generator, the clock circuit generating the clock signal from a differential clock input, and further receiving a bias current from the bias circuit.

5. The liquid crystal display apparatus as claimed in claim 1, wherein each of the receive circuits includes:

an operational amplifier for receiving the data LVDS and for performing level adjustment thereon so as to generate a gain signal having a magnitude of a transistor logic level; and a register disposed to receive the clock signal and coupled to the driving voltage generator and the operational amplifier, the register storing the gain signal from the operational amplifier and outputting the gain signal stored thereby as the logic signal according to the clock signal.

6. A source driving circuit comprising:

a low voltage differential signal (LVDS) receiver including:

a plurality of receive circuits, each disposed to receive a data LVDS and to perform level conversion upon the data LVDS to generate a logic signal, each of the receive circuits being operable in a selected one of a normal energy consuming mode and a power saving mode, and a power saving control circuit coupled to the receive circuits for controlling operation of the receive circuits in the power saving mode;

a driving voltage generator disposed to receive a clock signal and coupled to the receive circuits so as to receive the logic signals therefrom, the driving voltage generator being operable to generate a plurality of source driving voltages in parallel by performing series-to-parallel conversion upon the logic signals according to multiple periods of high-low logic transitions of the clock signal, the driving voltage generator further outputting an END signal; and a controller coupled to the driving voltage generator so as to receive the END signal therefrom, disposed to receive a data latch signal, and operable to output a power adjustment signal from the data latch signal and to stop output of the power adjustment signal upon receipt of the END signal from the driving voltage generator, the controller being coupled to the power saving control circuit for providing the power adjustment signal thereto, the power saving control circuit controlling the receive circuits to operate in the power saving mode when the power saving control circuit does not receive the power adjustment signal from the controller.

7. The source driving circuit as claimed in claim 6, wherein the power saving control circuit controls the receive circuits to operate in the normal energy consuming mode when the power saving control circuit receives the power adjustment signal from the controller.

8. The source driving circuit as claimed in claim 7, wherein the LVDS receiver further includes:

a bias circuit coupled to the controller and the receive circuits, the bias circuit receiving the power adjustment signal and being operable to provide bias currents for driving the receive circuits respectively, the bias currents being at a normal level when the bias circuit receives the power adjustment signal from the controller, the bias currents being at a level lower than the normal level when the bias circuit does not receive the power adjustment signal from the controller.

9. The source driving circuit as claimed in claim 8, further comprising a clock circuit coupled to the LVDS receiver and the driving voltage generator, the clock circuit generating the clock signal from a differential clock input, and further receiving a bias current from the bias circuit.

10. The source driving circuit as claimed in claim 6, wherein each of the receive circuits includes:

an operational amplifier for receiving the data LVDS and for performing level adjustment thereon so as to generate a gain signal having a magnitude of a transistor logic level; and a register disposed to receive the clock signal and coupled to the driving voltage generator and the operational amplifier, the register storing the gain signal from the operational amplifier and outputting the gain signal stored thereby as the logic signal according to the clock signal.

* * * * *